US011026009B2

(12) United States Patent
Ma

(10) Patent No.: US 11,026,009 B2
(45) Date of Patent: Jun. 1, 2021

(54) EARPHONE

(71) Applicant: XLENT AUDIO GROUP LIMITED, Kwun Tong (HK)

(72) Inventor: Hang Tat Ma, Kwun Tong (HK)

(73) Assignee: Xlent Audio Group Limited, Kowloon (HK)

( * ) Notice: Subject to any disclaimer, the term of this patent is extended or adjusted under 35 U.S.C. 154(b) by 0 days.

(21) Appl. No.: 16/616,343

(22) PCT Filed: May 15, 2019

(86) PCT No.: PCT/IB2019/054013
§ 371 (c)(1),
(2) Date: Nov. 22, 2019

(87) PCT Pub. No.: WO2019/220358
PCT Pub. Date: Nov. 21, 2019

(65) Prior Publication Data

US 2020/0177981 A1 Jun. 4, 2020

(30) Foreign Application Priority Data

May 18, 2018 (CN) ..... 201820754162.8

(51) Int. Cl.
*H04R 1/10* (2006.01)
*H04R 1/34* (2006.01)

(52) U.S. Cl.
CPC ..... *H04R 1/1016* (2013.01); *H04R 1/1058* (2013.01); *H04R 1/345* (2013.01)

(58) Field of Classification Search
CPC ..... H04R 1/1016; H04R 1/1075; H04R 1/24; H04R 25/65
See application file for complete search history.

(56) References Cited

U.S. PATENT DOCUMENTS 2,595,672 A * 5/1952 Greenwood ..... H04R 25/65 381/322
7,212,646 B2 * 5/2007 Nassimi ..... H04R 1/1058 381/380

(Continued)

FOREIGN PATENT DOCUMENTS

CN 204578737 U 8/2015
CN 105376669 A 3/2016
CN 208210244 U 12/2018

*Primary Examiner* — Ryan Robinson
(74) *Attorney, Agent, or Firm* — Muncy, Geissler, Olds & Lowe, P.C.

(57) ABSTRACT

The present utility model provides an earphone, comprising: a casing, a mounting plate and a sound guiding tube; wherein a receiving cavity is formed inside the casing, and the casing is provided with a first mounting hole connecting with the receiving cavity; the mounting plate is fixedly mounted in the receiving cavity and the mounting plate completely blocks the first mounting hole from connecting with the receiving cavity; one end of the mounting plate adjacent to the first mounting hole is provided with a sound-transmitting groove; one end of the sound guiding tube is a movable end, and the other end is a mounting end, and a sound guiding channel passing through the movable end and the mounting end is provided inside the sound guiding tube so that when the movable end portion is installed in the first mounting hole the sound guiding channel connects with the sound-transmitting groove and the movable end can rotate in the first mounting hole so as to enable the sound guiding tube to rotate relatively to the casing. The in-ear angle of the earphone can be adjusted, which improves the wearing comfort and sound quality of the earphone.

7 Claims, 3 Drawing Sheets

(56) References Cited

U.S. PATENT DOCUMENTS

| | | | | |
|---|---|---|---|---|
| 8,385,574 | B2 * | 2/2013 | Aquilina | H04R 25/60 381/328 |
| 9,055,366 | B2 * | 6/2015 | Azmi | H04R 1/1075 |
| 10,171,902 | B2 * | 1/2019 | Ball | H04R 1/1075 |
| 10,542,358 | B2 * | 1/2020 | Lindberg | H04R 1/1075 |
| 10,542,359 | B2 * | 1/2020 | Singer | H04R 25/60 |
| 2008/0152182 | A1 * | 6/2008 | Bevirt | H04R 1/1058 381/371 |
| 2008/0170714 | A1 * | 7/2008 | Major | H04R 25/656 381/87 |
| 2008/0170738 | A1 * | 7/2008 | Hope | H04R 1/1041 381/371 |

* cited by examiner

EARPHONE

TECHNICAL FIELD

The present utility model relates to the field of audio-visual appliances, particularly to an earphone.

BACKGROUND ART

Generally, for the convenience of production, the shape and size of the left earphone and the right earphone are fixed and consistent for in-ear earphones, which results in the same angle of the left and right earphones into ears. However, since different people have different ear canal structure and even the same person has different left and right ear canals. Thus, the same entry angle for the left and right earphones may cause inconsistent feeling in the left and right ear canals when wearing the earphones, thereby affecting the actual experience of wearers.

SUMMARY

In order to solve the above problems, the present utility model provides an earphone with adjustable in-ear angle.

The present utility model is realized by the following technical solutions:

The present utility model provides an earphone, wherein the earphone comprises:

a casing, wherein a receiving cavity is formed inside the casing, and the casing is provided with a first mounting hole connecting with the receiving cavity;

a mounting plate, wherein the mounting plate is fixedly mounted in the receiving cavity and the mounting plate completely blocks the first mounting hole from connecting with the receiving cavity; and one end of the mounting plate adjacent to the first mounting hole is provided with a sound-transmitting groove; and a sound guiding tube, wherein one end of the sound guiding tube is a movable end, and the other end of the sound guiding tube is a mounting end, and a sound guiding channel passing through the movable end and the mounting end is provided inside the sound guiding tube so that when the movable end portion is installed in the first mounting hole the sound guiding channel connects with the sound-transmitting groove and the movable end can rotate in the first mounting hole so as to enable the sound guiding tube to rotate relatively to the casing; and the sound guiding tube can be installed into the first mounting hole or be detached from the first mounting hole manually.

In addition, a first mounting slot is disposed at one end of the mounting plate away from the first mounting hole, a first sound-transmitting hole is disposed at a bottom of the first mounting slot, and the first sound-transmitting hole is in connection with the sound-transmitting groove.

In addition, a second mounting slot is further disposed at one end of the mounting plate away from the first mounting hole, a second sound-transmitting hole is disposed at a bottom of the second mounting slot, and the second sound-transmitting hole is in connection with the sound-transmitting groove.

In addition, the earphone further comprises: a cover plate, which is fixedly connected to an end of the casing away from the first mounting hole.

In addition, the earphone further comprises: a decorative plate, which is mounted at an end of the cover plate away from the casing and can be manually mounted to the cover plate or detached from the cover plate.

In addition, the earphone further comprises: an earplug sleeve, which is detachably sleeved on the mounting end.

The beneficial effects of the present utility model are as follows:

The earphone provided by the present utility model can adjust the in-ear angle, which improves the wearing comfort and thereby improve the sound quality of the earphone. In addition, the sound guiding tube can be manually removed from or installed to the casing, which is very convenient for users to replace the sound guiding tube or clean the earphones.

DETAILED DESCRIPTION

In order to explain the technical solutions of the present utility model more clearly and completely, the present utility model will be further described as below in conjunction with the attached drawings.

Figure 1:
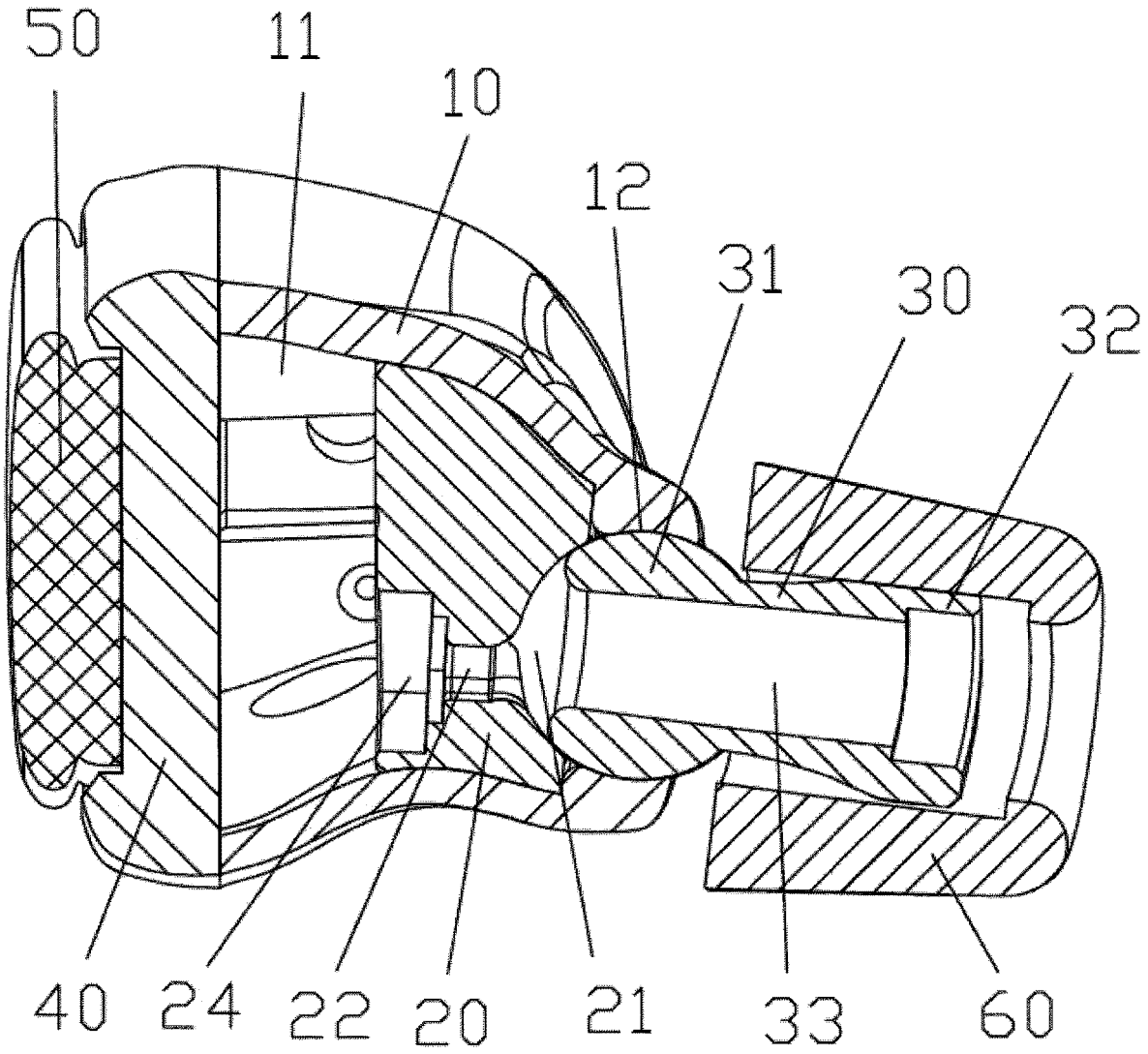
FIG. 1 is a cross-sectional view of an earphone provided by the present utility model.
Figure 2:
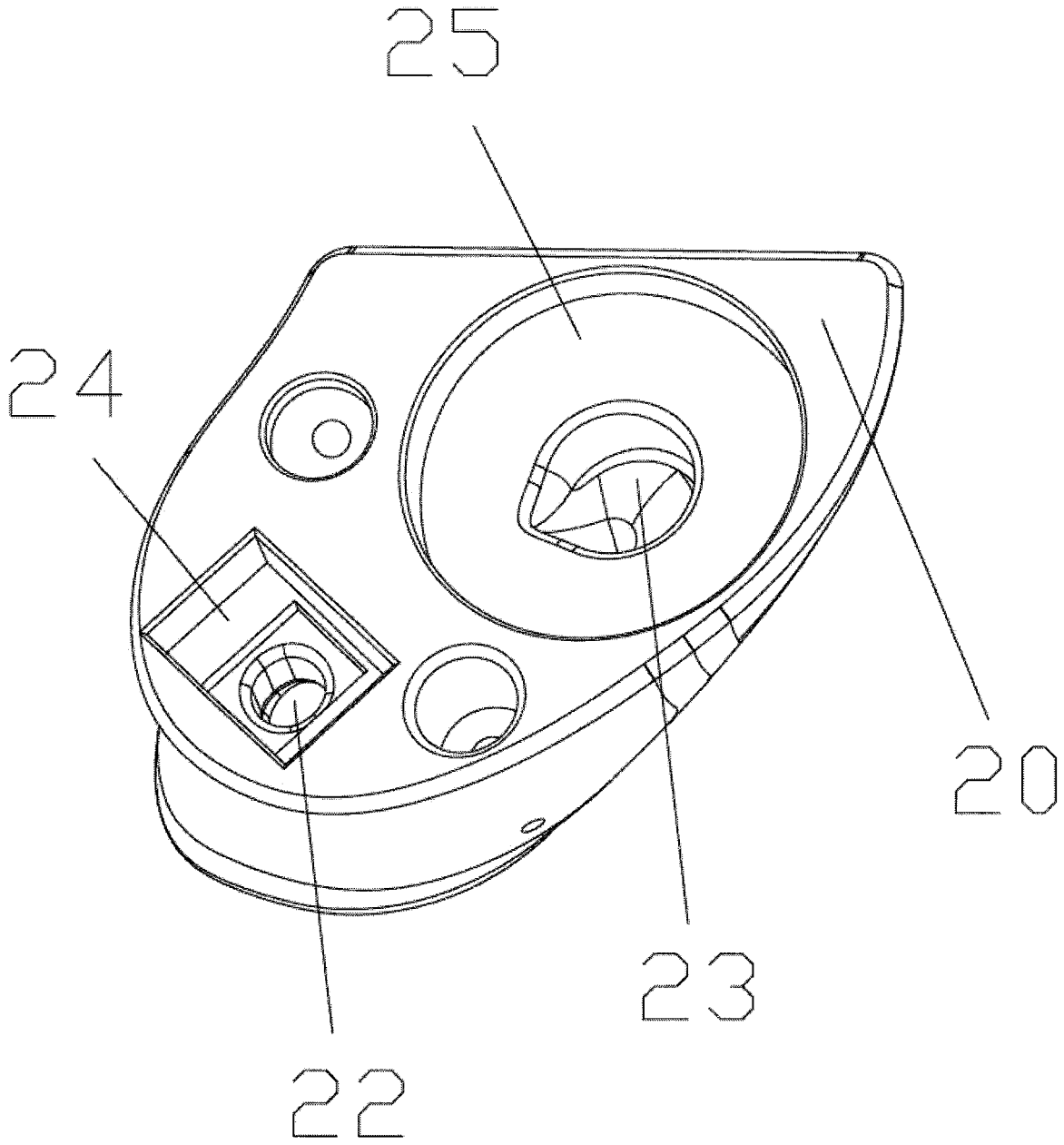
FIG. 2 is a perspective view of a mounting plate of an earphone provided by the present utility model.
Figure 3:
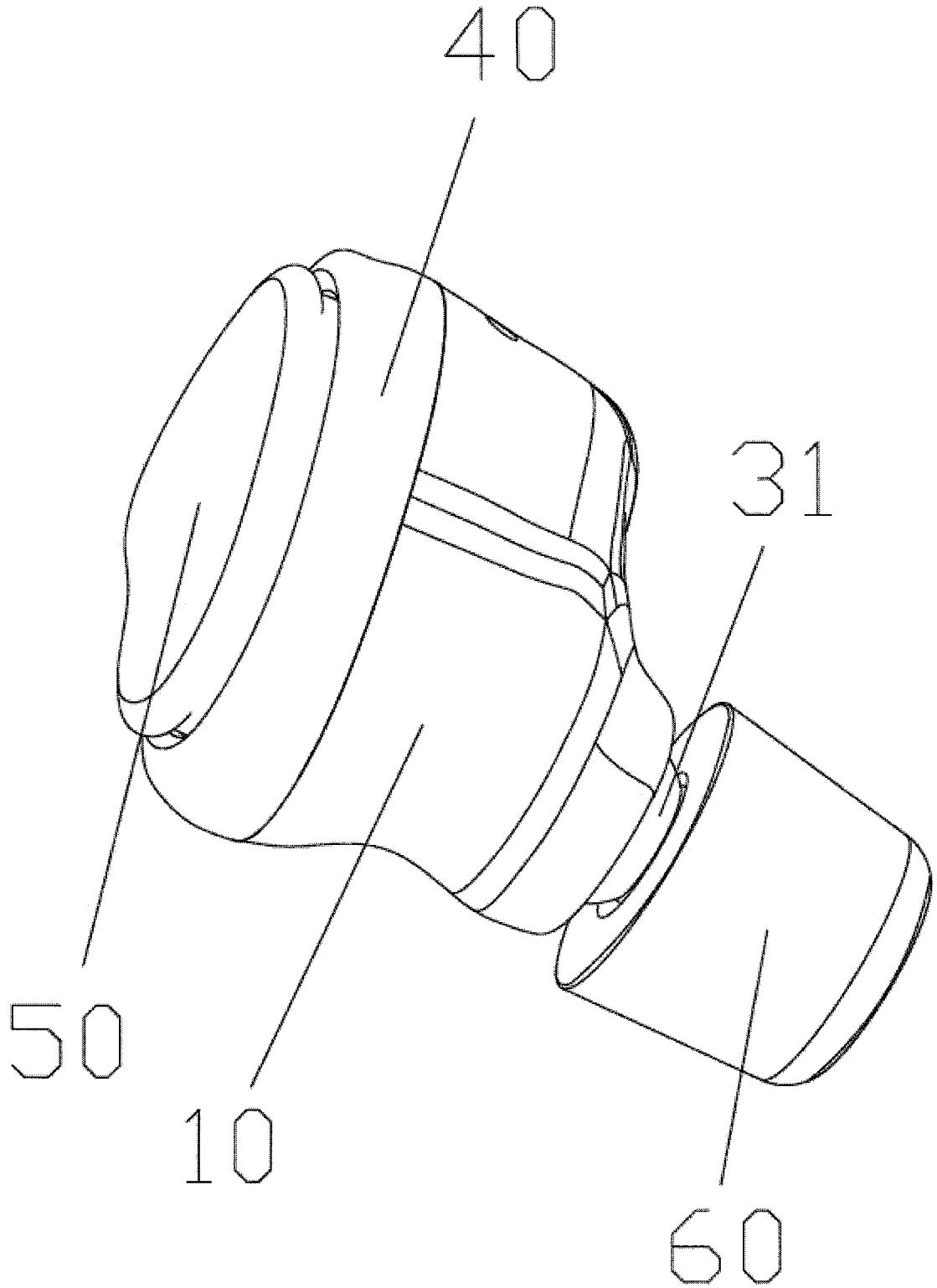
FIG. 3 is a perspective view of an earphone provided by the present utility model.

Please refer to FIG. 1 to FIG. 3, the present utility model provides an earphone, wherein the earphone comprises:

a casing 10, wherein a receiving cavity 11 is formed inside the casing 10, and the casing 10 is provided with a first mounting hole 12 connecting with the receiving cavity 11;

a mounting plate 20, wherein the mounting plate 20 is fixedly mounted in the receiving cavity 11 and the mounting plate 20 completely blocks the first mounting hole 12 from connecting with the receiving cavity 11; and one end of the mounting plate 20 adjacent to the first mounting hole 12 is provided with a sound-transmitting groove 21; and a sound guiding tube 30, wherein one end of the sound guiding tube 30 is a movable end 31, and the other end of the sound guiding tube 30 is a mounting end 32, and a sound guiding channel 33 passing through the movable end 31 and the mounting end 32 is provided inside the sound guiding tube 30 so that when the movable end 31 portion is installed in the first mounting hole 12 the sound guiding channel 33 connects with the sound-transmitting groove 21 and the movable end 31 can rotate in the first mounting hole 12 so as to enable the sound guiding tube 30 to rotate relatively to the casing 10; and the sound guiding tube 30 can be installed into the first mounting hole 12 or be detached from the first mounting hole 12 manually.

In the present embodiment, when a user wears the earphone, the in-ear angle of the earphone is adjusted by rotating the sound guiding tube 30 to achieve optimal wearing comfort, thereby improving the sound quality of the earphone; and in addition, the sound guiding tube 30 can be manually mounted into the first mounting hole 12 or detached from the first mounting hole 12, and a user can replace the sound guiding tube 30 according to actual conditions, which improves wearing comfort and sound quality of the earphone to the maximum extent. The earphone provided by the present utility model can adjust the in-ear angle of the earphone, which improves the wearing comfort and thereby improve the sound quality of the earphone. In addition, the sound guiding tube 30 can be manually removed from or installed to the casing 10, which is very convenient for users to replace the sound guiding tube 30 or clean the earphone.

Please refer to FIG. 1 and FIG. 2. A first mounting slot 24 is disposed at one end of the mounting plate 20 away from the first mounting hole 12, a first sound-transmitting hole 22 is disposed at a bottom of the first mounting slot 24, and the first sound-transmitting hole 22 is in connection with the sound-transmitting groove 21. A second mounting slot 25 is further disposed at one end of the mounting plate 20 away from the first mounting hole 12, a second sound-transmitting hole 23 is disposed at a bottom of the second mounting slot 25, and the second sound-transmitting hole 23 is in connection with the sound-transmitting groove 21.

In the present embodiment, the first mounting slot 24 and the second mounting slot 25 are used to mount other components of the earphone, such as a sounding unit; wherein sound made in the receiving cavity 11 passes through the first sound-transmitting hole 22 and the second sound-transmitting hole 23 to be transmitted to the sound-transmitting groove 21, and then transmitted by the sound-transmitting groove 21 to the sound guiding channel 33 and finally transmitted out of the earphone through the sound guiding channel 33 to enter a wearer's ear canals.

Please refer to FIG. 1 and FIG. 3. The earphone further comprises: a cover plate 40, which is fixedly connected to an end of the casing 10 away from the first mounting hole 12. The earphone further comprises: a decorative plate 50, which is mounted at an end of the cover plate 40 away from the casing 10 and can be manually mounted to the cover plate 40 or detached from the cover plate 40.

In the present embodiment, the cover plate 40 is fixedly connected to the casing 10, and the cover plate can effectively protect the components installed in the receiving cavity 11. The decorative plate 50 can be manually mounted to the cover plate 40 or detached from the cover plate 40. Thus, users can replace the decorative plate 50 of different styles according to their own preferences, which can meet the individual needs of users.

Please refer to FIG. 1 and FIG. 3. The earphone further comprises: an earplug sleeve 60, which is detachably sleeved on the mounting end 32.

In the present embodiment, the earplug sleeve 60 is a soft rubber earplug or a sponge earplug. When a user wears the earphone, the earplug sleeve 60 is compressed to fill the ear canal so as to improve the comfort of wearing the earphone and achieve good soundproof effect.

Of course, the present utility model further has a plurality of other embodiments. Based on the present embodiment, other embodiments obtained by those skilled in the art without any creative work are within the scope of protection of the present utility model.

What is claimed is:

1. An earphone, wherein the earphone comprises:

a casing, wherein a receiving cavity is formed inside the casing, and the casing is provided with a first mounting hole connecting with the receiving cavity;

a mounting plate, wherein the mounting plate is fixedly mounted in the receiving cavity and the mounting plate completely blocks the first mounting hole from connecting with the receiving cavity; and one end of the mounting plate adjacent to the first mounting hole is provided with a sound-transmitting groove; and a sound guiding tube, wherein one end of the sound guiding tube is a movable end, and the other end of the sound guiding tube is a mounting end, and a sound guiding channel passing through the movable end and the mounting end is provided inside the sound guiding tube so that when a portion of the movable end is installed in the first mounting hole, a part of the portion of the movable end fits inside the sound-transmitting groove, and the sound guiding channel connects with the sound-transmitting groove and the movable end can rotate in the first mounting hole so as to enable the sound guiding tube to rotate relatively to the casing; and the sound guiding tube can be installed into the first mounting hole or be detached from the first mounting hole manually.

2. The earphone according to claim 1, wherein a first mounting slot is disposed at one end of the mounting plate away from the first mounting hole, a first sound-transmitting hole is disposed at a bottom of the first mounting slot, and the first sound-transmitting hole is in connection with the sound-transmitting groove.

3. The earphone according to claim 1, wherein a second mounting slot is further disposed at one end of the mounting plate away from the first mounting hole, a second sound-transmitting hole is disposed at a bottom of the second mounting slot, and the second sound-transmitting hole is in connection with the sound-transmitting groove.

4. The earphone according to claim 1, wherein the earphone further comprises: a cover plate, which is fixedly connected to an end of the casing away from the first mounting hole.

5. The earphone according to claim 4, wherein the earphone further comprises: a decorative plate, which is mounted at an end of the cover plate away from the casing and can be manually mounted to the cover plate or detached from the cover plate.

6. The earphone according to claim 1, wherein the earphone further comprises: an earplug sleeve, which is detachably sleeved on the mounting end.

7. The earphone according to claim 1, wherein the first mounting hole and the sound-transmitting groove collectively form a partially spherical groove, the movable end is formed in a partially spherical shape, so as to enable the sound guiding tube to move laterally and circularly.

* * * * *